US005843283A

United States Patent [19]

Henssler et al.

[11] Patent Number: 5,843,283

[45] Date of Patent: Dec. 1, 1998

[54] LUBRICATION OF A ROLL JACKET OF A PRESS ROLLER

[75] Inventors: Joachim Henssler, Ravensburg; Josef Muellner, Heidenheim; Christian Steiger, Ravensburg; Karl Steiner, Herbrechtingen; Wolfgang Schuwerk, Kisslegg; Ulrich Wieland, Berg, all of Germany

[73] Assignee: Voith Sulzer Papiermaschinen, Heidenheim, Germany

[21] Appl. No.: 753,789

[22] Filed: Dec. 2, 1996

[30] Foreign Application Priority Data

Dec. 1, 1995 [DE] Germany ..... 195 44 978.9

[51] Int. Cl.[6] ..... D21F 3/08

[52] U.S. Cl. ..... 162/358.3; 162/272; 162/361; 492/7; 492/20

[58] Field of Search ..... 162/358.3, 272, 162/361; 492/7, 16, 20

[56] References Cited

U.S. PATENT DOCUMENTS

| | | | |
|---|---|---|---|
| 3,970,515 | 7/1976 | Busker | 162/358.3 |
| 4,556,454 | 12/1985 | Dahl et al. | 162/358.3 |
| 4,917,767 | 4/1990 | Ilmarinen et al. | 162/358.3 |
| 5,110,417 | 5/1992 | Lehtonen et al. | 162/358.3 |
| 5,262,011 | 11/1993 | Iimarinen | 162/358.3 |
| 5,302,252 | 4/1994 | Gotz | 162/358.3 |

FOREIGN PATENT DOCUMENTS

| | | |
|---|---|---|
| 345501B | 11/1992 | European Pat. Off. . |
| 4040392 | 6/1991 | Germany . |
| 4337583 | 5/1995 | Germany . |
| 2239268 | 6/1991 | United Kingdom . |
| 9313263 | 7/1993 | WIPO . |

*Primary Examiner*—Karen M. Hastings
*Attorney, Agent, or Firm*—Ostrolenk, Faber, Gerb & Soffen, LLP

[57] ABSTRACT

A press roller having a stationary carrier and a roll jacket which rotates past the support surface of the stationary carrier. A support element on the carrier, like a shoe, is pressed against the inside circumferential surface of the roll jacket by a pressure space that is beneath and acts upon the support element to press it toward the roller jacket. The support surface is at least partially hydrodynamically lubricated at the support surface of the support element. The support surface has at least one row and perhaps a plurality of rows that extend in the direction of the press roller axis comprised of a plurality of oil feed points which are separated from one another along the roller axis. The oil feed points are supplied at least partially independently of the pressure space. Each oil feed point comprises a throttling bore. One or more distribution channels in the support element deliver oil to the bores or to groups of the bores.

52 Claims, 5 Drawing Sheets

LUBRICATION OF A ROLL JACKET OF A PRESS ROLLER

BACKGROUND OF THE INVENTION

The invention relates to a press roller typically for use in a paper making machine and particularly to distribution of lubrication over the support for a roll jacket of the press roller.

The press roller to which the invention is directed has a stationary carrier or beam and has a revolving roll jacket, which rotates around the carrier and is supported on the carrier by at least one support element which can be pressed against the inside circumferential surface of the roll jacket. Movement of the roll jacket over the support element is at least partially hydrodynamically lubricated. The support element has a support surface that faces toward the inside circumferential surface of the roll jacket and extends in the running direction of the roll jacket. The support surface has several oil feed points, by which fresh lubricating oil is supplied to the support surface at the region between the support surface and the inside circumferential surface of the roll jacket, where the feed of fresh lubricating oil takes place at least partially independently of a pressure space which is located at the carrier and the support element and which acts on the support element.

Such press rollers are used, in particular, in press devices with a so called extended press zone sometimes called an extended, or wide, or long nip press zone. Such press devices can be used, for example, in the press sections of paper making machines, but also may be used in sizing and glazing mills.

In such a press roller, significant friction can occur during operation, i.e. while the roll jacket is rotating, in spite of the at least partial hydrodynamic lubrication. The friction causes roll jacket wear and must be compensated by greater drive output.

It has already been proposed to spray additional oil onto the inside circumferential surface of the roll jacket at the entry region of the press zone in the circumferential direction, in order to reduce the drive output. It has also already been proposed to provide the support surface of the support element with a slit which extends over the entire width of the press zone, in the intake side edge region. Friction losses can be reduced to a certain extent by these measures. However, if any of the roll jacket, a felt band passed through the press zone, the material web or similar material that is to be pressed, or the counter-surface, for example, defined by a counter-roller, includes any irregularities in the form of thicker points or uneven areas, the pressure will become so high at certain points that the press zone is supplied only with a very small amount of oil there, or with no oil at all. At the points in question, oil may be stripped off at the slit.

A press roller of the type indicated above is known from DE 40 40 392 A1. Several grooves are provided in a pocket formed in the support surface of the support element. The grooves extend essentially over the entire width of the press zone. Lubricant channels open into each of these grooves. In one exemplary embodiment, three grooves are provided in the pocket, wherein two of the grooves lie behind one another in the direction of the roller axis. It is possible to provide hydrostatic support of the roll jacket, i.e., the liquid under pressure itself supports the roll jacket during start-up of the press arrangement, and to have the roll jacket be hydrodynamically supported, i.e., the rotation of the jacket builds up the lubrication support for the jacket at normal circumference velocity. But here again, because of irregularities in the roll jacket, or in a felt band passed through the press zone, or in the counter-surface, particularly formed by a counter-roller, or by the web-like rolled product, areas of greater pressure will occur, at which the oil supply is reduced or even interrupted.

An additional factor is that the lubricants which produce the hydrodynamic support of the roll jacket in a press roller with hydrodynamic lubrication of the support element are strongly heated on the path from the intake side to the exit side of the support element. The degree of heating of the lubricant film is dependent, among other things, on its pressure progression and, in this connection, particularly on the gradient and the maximum of this progression, as well as on the machine speed. Increased heating reduces the viscosity of the lubricant oil, thereby reducing its hydraulic support capacity, or even causes break down of the oil in certain cases. In addition, as the machine speed increases, it becomes more difficult to sufficiently cool the hot oil film after it has passed through the lubricant gap, or to replace it. A particular problem is that lubricant oil that is introduced at the intake is not entrained to a sufficient degree and is not drawn into the lubricant gap. This is again attributable, among other reasons, to the uneven thickness of the elements which jointly pass between the support element and the counter-roller, as mentioned before.

Great differences in thickness of the elements passing the support element also frequently result in wedging between the support element and the counter-roller, particularly in the recessed pocket, and thereby cause destruction. Consider also that in a hydrodynamically produced lubricant gap, the thickness of the lubricant film is at its lowest value at the location with the greatest negative ratio of the local pressure gradient to the local viscosity, in terms of amount. In normal press zones, this location is in the region of the press zone exit, where a negative value results as the pressure drops.

SUMMARY OF THE INVENTION

The object of the invention is to provide a press roller of the type described above, in which an optimum supply of fresh, cool lubricant oil is guaranteed even under varying operating conditions, to ensure the most uniform possible temperature distribution over the support surface of the support element.

According to the invention, the support surface has at least one axially extending row of a plurality of oil feed points that extends in the direction of the roller axis. The feed points are separated from one another. They are supplied at least partially independently of the hydraulic pressure space which acts on the support element in the direction toward the counter-roller.

Each oil feed point comprises a bore in the support surface extended into the support elements. In the region of each bore, and preferably in its interior, throttling occurs. This may be where the oil feed points are preferably formed by a local depression of the support surface and by a throttling bore opening into this depression, and where separating ridges are provided between the depressions, and the surfaces of the ridges lie at least essentially on the same level as the rest of the support surface.

This formation guarantees a uniform supply of fresh, cool lubricant oil even if increased pressure is cause at certain points over the support surface by irregularities in the roll jacket, or in a felt band or similar material passed through the press zone, or in the material web to be treated, particularly paper or cardboard, or in the counter surface, for example formed by a counter roller. Such an uninterrupted supply of fresh, cool lubricant oil is therefore particularly guaranteed even at those locations where scraps of paper, folds or thickened areas of the fiber web to be treated, for example, pass through the press zone. While cross flow or axial flow of the lubricant oil along the support surface is practically precluded by the ridges, the bores with their throttle characteristics ensure that excessive lubricant oil will not escape due to a locally reduced load, in other words, due to a gap opening, particularly at a border region, and thus assures that the supply of oil to those press locations under a greater load is not lost. Because of this separation of the plurality of oil feed points in an individual row, as well as of the feed being at least partially independent of the pressure space for the support element, sufficiently high pressure is provided and any local irregularities which occur can be compensated without difficulty. This practically precludes the possibility that local irregularities which occur might temporarily or might permanently reduce or interrupt the feed of fresh, cooled pressure oil. Oil supply is guaranteed, particularly at the critical points of high pressure stress. Therefore, another goal of obtaining the most uniform possible temperature distribution can also be achieved. The press roller according to the invention can therefore advantageously be used particularly also for those press devices in which it is normally expected that paper scraps or folds or thickened areas of fiber material will pass through the press zone. The same set of problems also always occurs at the edges of the product web, where the web thickness abruptly ends.

The row of oil feed points in each instance preferably has at least one distribution channel formed in the support element assigned to it. That channel may supply several oil feed points jointly with fresh lubricant oil. Also, several distribution channels which lie one after the other in the direction of the roller axis can be provided. The bores can be individually connected with a respective distribution channel, at least in part, and/or can be brought together in groups and connected with the distribution channel in these groups, at least in part.

Preferably, means individually adjust the pressure values and/or amount of fresh lubricant oil that is supplied, with regard to individual bores and/or groups of bores. This makes it possible to adapt the press roller to different operating conditions, as needed, in the simplest manner possible.

The oil supply to an individual row of oil feed points can be accomplished completely independently of the pressure space which acts on the support element or partially via this pressure space. Combined lubrication including oil delivered via the pressure space provides the contact pressure for the support element and provides additionally supplied oil, so that good emergency lubrication may still be provided via the pressure space, if the additional oil supply fails. This type of lubrication can be used for all the support elements, independent of the type of line force generation (e.g., long piston, piston row, pressure profile change, pressure profile adjustment with flexible contact strip, etc.).

It is advantageous if the supply of fresh lubricant oil along a row of oil feed points alternates between oil supply independently of the pressure space which acts on the support element on the one hand and supply via the pressure space which acts on the support element on the other hand.

In addition to the at least one row of a plurality of oil feed points, which are separated from one another and are supplied at least partially independently of the pressure space which acts on the support element, there may be at least one more row of a plurality of oil feed points, oriented parallel to the first row, separated from one another, and supplied with oil via the pressure space. In this case, a first row with one type of supply and a second row with the other type of supply, and parallel to the first row, can alternately be provided in the running direction of the roll jacket. Different rows of oil feed points which are separated from one another and are supplied at least partially independently of the pressure space are preferably supplied with fresh lubricant oil separately from one another.

It is possible to optimally adapt to different operating conditions if the pressure values for the oil feed points in one row which are supplied at least partially independently of the pressure space, and/or the pressure values for the oil feed points in different rows, which are supplied at least partially independently of the pressure space, can be adjusted separately. For variable adjustment of different pressure progressions, it is also possible to have support elements which can be pushed against one another radially. In this case, it is practical to seal adjacent support elements off relative to one another, without a gap.

Particularly with regard to optimum temperature distribution, it is advantageous to provide several parallel rows, each having a plurality of oil feed points, separated from one another, supplied at least partially independently of the pressure space, where the oil feed points of two adjacent rows are preferably offset relative to one another crosswise to the running direction of the roll jacket, i.e., the points in one row are arranged in the axial direction gap relative to the points in another, adjacent row.

Particularly with regard to the most uniform possible temperature distribution which is a goal, it is also advantageous if at least one row of a plurality of oil feed points, separated from one another, and supplied at least partially independently of the pressure space, is arranged in the region between ¼ to ¾, and preferably ½ to ¾ of the support surface, as viewed in the running direction of the roll jacket.

Other features and advantages of the present invention will become apparent from the following description of exemplary embodiments of the invention which refers to the accompanying drawings.

DETAILED DESCRIPTION OF PREFERRED EMBODIMENTS

Figure 1:
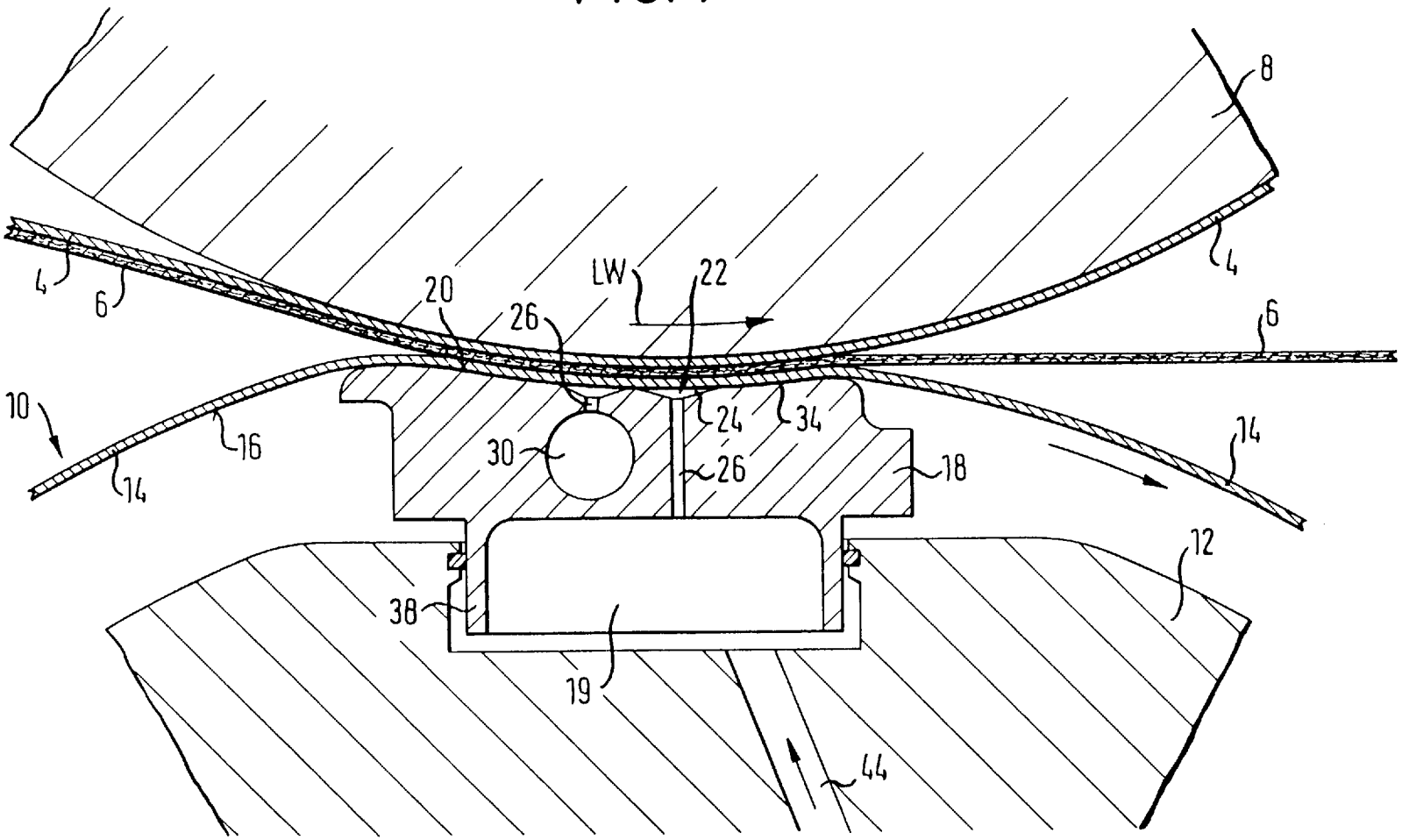
FIG. 1 is a schematic view, partially in cross-section, of a part of a press roller where it meets a counter-roll and showing the invention.
Figure 4:
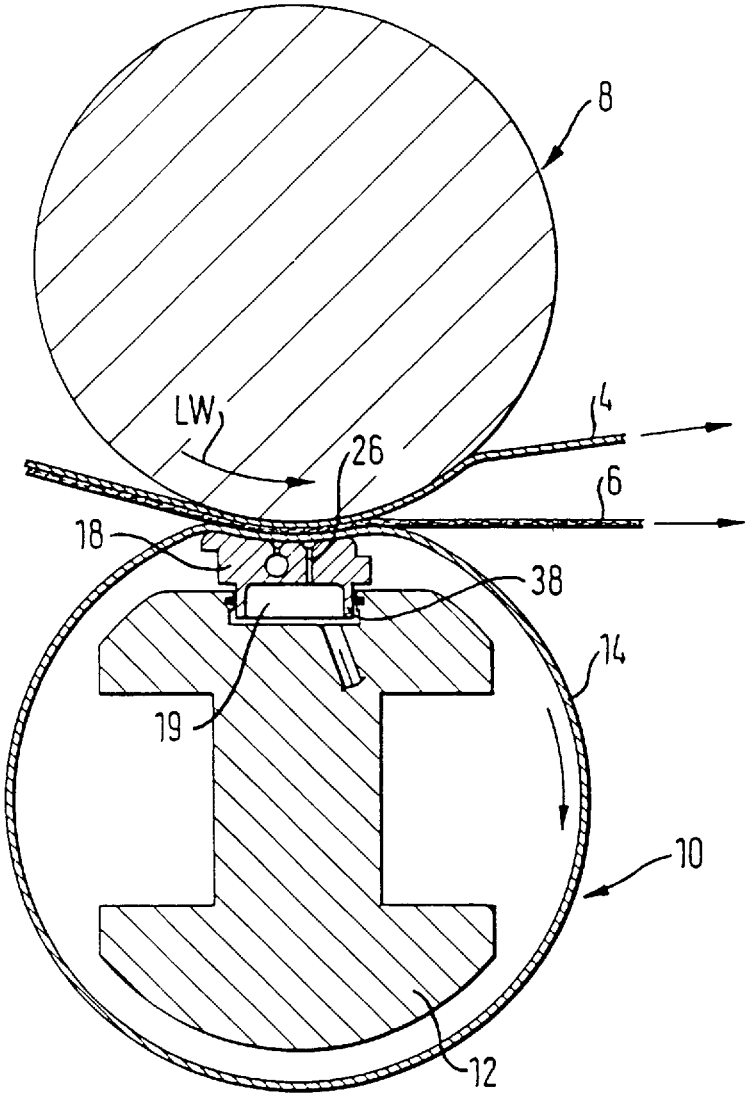
FIG. 4 is a schematic cross-sectional view of a press roller comparable to the one roller in FIG. 1, but where an oil feed point that is supplied via the pressure space is shown.

FIGS. 1 and 4 provide a schematic view of a press roller 10 comprising a stationary carrier or beam 12 and a rotating roll jacket, 14. A typical roll jacket is typically a plastic composition, endless loop, flexible belt, which develops a generally rounded cross-section due to centrifugal force and which also deforms to the profile of the support surface of the support element and the counter roll as the roll jacket moves through the press nip at the press zone. The roll jacket 14 rotates around the stationary carrier 12. It is supported on the carrier 12 by at least one support element 18 which can be pressed against the inside circumferential surface 16 of the jacket 14.

The support element 18 is often called a shoe and the press roller may be called a shoe press roller. The support element 18 includes a support surface 20 which faces the inside circumferential surface 16 of the roll jacket 14. That surface is at least in part hydrodynamically lubricated in the present case. The support surface 20 is extended in the running direction LW of the roll jacket 14 over the surface 20, in order to form a so-called extended press zone together with a counter-surface, which is formed, for example, by a counter-roller 8.

Additional fresh, cooled lubricant oil is provided to the lubrication gap formed between the roll jacket 14 and the support surface 20. For this purpose, the support surface 20 has several oil feed points 22 (see also FIGS. 2, 3, and 5–9). Additional fresh lubricant oil is provided at least partially independently (meaning including up to completely independently) of a pressure space 19 that is formed under the support element and in the carrier 12, where the pressure in the space 19 acts on the support element 18.

There may be a plurality of separately pressable support elements arrayed along the axis of the press roller. It is advantageous if each one can be moved in the radial direction relative to the others, particularly in order to obtain different pressure progressions. Basically, it is also possible to seal the support elements 18 relative to one another without a gap, at least in groups, while maintaining their desired relative mobility.

The oil feed points 22 are arranged in axial rows. At least one row $R_i$ extends in the direction of the roller axis and is comprised of a plurality of oil feed points, axially separated from one another, and each supplied at least partially independently of the pressure space 19 (FIGS. 2, 3, 5, and 6). Each oil feed point 22 is preferably formed by a local depression 24 in the support surface 20 and a capillary-like bore 26 from the pressure space 19 which opens into the depression 24. Ridges 28 are provided in the axial spaces between and define the depressions 24. The ridges have outward surfaces that preferably lie at least essentially on the same level as the remainder of the support surface, i.e., they are not recessed.

Figure 2:
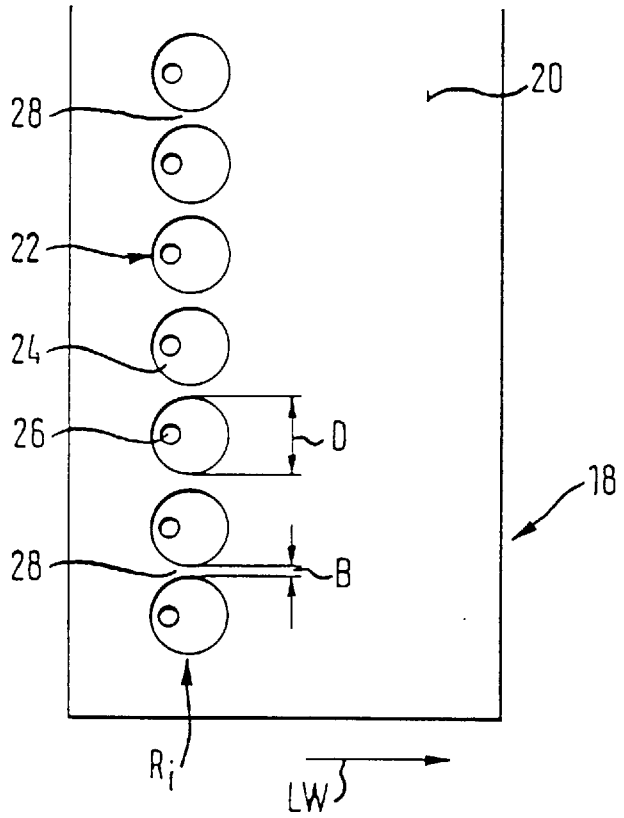
FIG. 2 is a top view of a part of the support element of the press roller shown in FIG. 1, with the roll jacket omitted.
Figure 3:
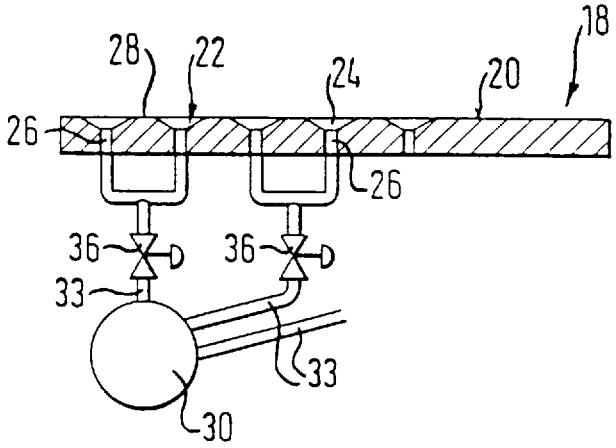
FIG. 3 is a cross-section through part of the support element shown in FIG. 2, cut along the row of oil feed points.

In each of the embodiments shown in FIGS. 2 and 3, only one axial row of oil feed points 22 is provided. In contrast, the embodiment variants shown in FIGS. 1, 4, and 5 contain two such rows. However, a different number of rows, and particularly a greater number of rows, may also be provided. In addition, it is possible that rows of oil feed points extend only over part of the axial width of the support element 18 and also possible that adjacent rows are arranged in such a way that one extends over one part of the axial width, while the other extends over all other parts of the axial width.

An oil distributor channel 30 is preferably formed in the support element 18. One channel can be provided for each of the rows $R_i$ of oil feed points 22 (see FIG. 1). Each channel preferably extends generally in the direction of the roller axis.

Several oil feed points 22 in one row are jointly supplied with fresh, cool lubricant oil via each distributor channel 30. In the simplest case, each row $R_i$ of oil feed points can have a single distributor channel 30 assigned to it. It is also possible, however, to provide several distributor channels 30, which lie one after the other in the direction of the roller axis, for each row $R_i$. Basically, oil feed from one axial side or also from both axial sides of the support element is possible. The oil distributor can be cylindrical or can be conical along its length, for example, or can also have a stepped cross-section. Finally, it is advantageous if the cross-section of the inlet opening, or the total of the cross-sections of the inlet openings of the distributor channel 30, be greater than the total of all the cross-sections of the bores 26 connected with this channel.

In an embodiment which is preferred for practical reasons, each bore 26 has a diameter in the range of about 0.3 mm to 3 mm, and preferably 1 mm. The length of each bore 26 is preferably about 5 to 100 mm, and preferably 5 to 50 mm. Instead of forming the bores as capillary-like, however, other types of throttling are also possible, as a matter of principle.

In addition, it is necessary that the oil pressure in the region of the inlet openings of the bores 26 be greater than the pressure in the lubricant film 34 over the support surface 20 of the support element 18.

The bores 26 can be connected individually with the distributor channel 30, at least in part. According to FIG. 3, however, the bores 26 can also be grouped together, at least in part, and can be connected with the distributor channel 30 in groups. In the embodiment shown in FIG. 3, the bores 26 are grouped in pairs and are connected with the distributor channel 30 via a feed line 33 which is common to the pair of bores in question.

Other means, particularly valves, throttle valves or similar means, may be provided in order to separately adjust the values for pressure and/or for the amount of the fresh lubricant oil to be supplied, with regard to individual bores 26 and/or groups of bores 26. In the embodiment of FIG. 3, such a valve 36 is used in each of the feed lines 33. Basically, however, it is also possible to assign individual means of control and regulation to at least individual bores 26. Each bore may be provided with a respective shutter to shut off oil flow therethrough, as well.

With regard to a row $R_i$ of oil feed points 22 in each instance, the supply of fresh, cooled lubricant oil can take place completely independently of the pressure space 19 which acts on the support element 18, or also the supply can be partially via this pressure space 19. FIG. 4 shows an oil feed point 22 including a bore 26 which opens directly into the pressure space 19 which acts on the support element 18. In contrast, in the embodiment shown in FIG. 3, the feed lines 33 are connected with the distributor channel 30, which is supplied with fresh, cooled lubricant oil from the outside, i.e., independently of the pressure space 19 which acts on the support element 18.

Instead of supplying all the oil feed points 22 of a row $R_i$ in each instance externally, it is also possible, for example, to provide the supply of fresh lubricant oil along the row $R_i$ alternately independently of the pressure space 19 and via the pressure space 19. Adjacent oil feed points 22 of a row, in each instance, are then supplied in different ways.

Furthermore, in addition to at least one row $R_i$ of a plurality of oil feed points, separated from one another, and supplied at least partially independently of the pressure space, there is at least another row of a plurality of oil feed points parallel to the first row, and again separated from one another, but supplied via the pressure space. The rows $R_i$ are preferably arranged so that they alternate, preferably one row $R_i$ of a plurality of oil feed points 22, which are separated from one another, are supplied at least partially independent of the pressure space, and a parallel row $R_i$ of a plurality of oil feed points 22, which are independent of one another, are supplied via the pressure space.

Combined lubrication having an oil feed both via the pressure space and from the outside has the advantage, among others, that if the additional oil supply fails, sufficient emergency lubrication will still be ensured via the pressure space. This type of lubrication can be used for all of the support elements, independent of the type of line force generation, e.g., long piston, piston row, pressure profile change, pressure profile adjustment with flexible contact strip.

With a plurality of rows $R_i$ each including a plurality of oil feed points 22, separated from one another, and supplied at least partially independently of the pressure space, a separate supply of fresh lubricant oil can be provided to each or to all of the rows. Preferably, the pressure values for the oil feed points 22 in one row $R_i$ which are supplied at least partially independently of the pressure space, and/or the pressure values for the oil feed points, in different rows which are supplied at least partially independent of the pressure space, can be adjusted separately. It is also possible to adjust the pressure values of several oil feed points 22 jointly, as was described on the basis of FIG. 3.

The pressure adjustments can be done manually or can also be electronically controlled. Preferably, the oil pressure in the region of the inlet openings of the bores 26 can also be adjusted to such a high value, at least temporarily, that the roll jacket 14 is hydrostatically supported, i.e., the liquid under pressure itself supports the jacket. For practical purposes, it is sufficient if such high pressure values are generated during start-up. During operation, lubrication should preferably be essentially hydrodynamic, i.e., the rotation of the jacket builds up the lubrication support for the jacket.

The depressions 24 define a continuous transition into the support surface 20 partly formed by the ridges 28, at least on one side of the oil feed points in the surface 20. This transition is preferably formed by a convex curvature. Such transitions can be provided both in the running direction LW of the roll jacket 14 (see FIGS. 1, 4, and 7 to 9), and in the crosswise direction of the support element 18 (see FIG. 3). This makes it possible for the depressions to make a continuous transition into the support surface 20 partly formed by the ridges 28, on all sides of the feed holes 22, for example. It is advantageous if each depression 24 has a maximum depth T of less than 0.5 mm, particularly less than 0.3 mm, and preferably less than 0.1 mm.

According to FIG. 2, the depressions 24 are essentially circular, viewed from above. However, in a top view, they can also have a rectangular, triangular or diamond shape, or also a contour with straight or curved or rounded edges. Further, the depressions 24 of one row $R_i$, can all have the same contour or respective different contours in a top view, in such a way that adjacent depressions 24 overlap when viewed in the running direction LW, while a ridge 28 between them is maintained.

Figure 6:
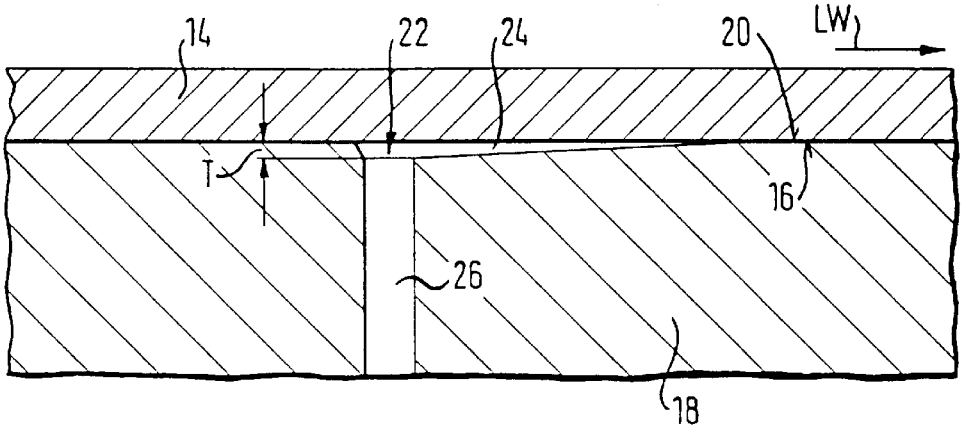
FIG. 6 is a schematic view of an exemplary embodiment of an oil feed point.
Figure 8:
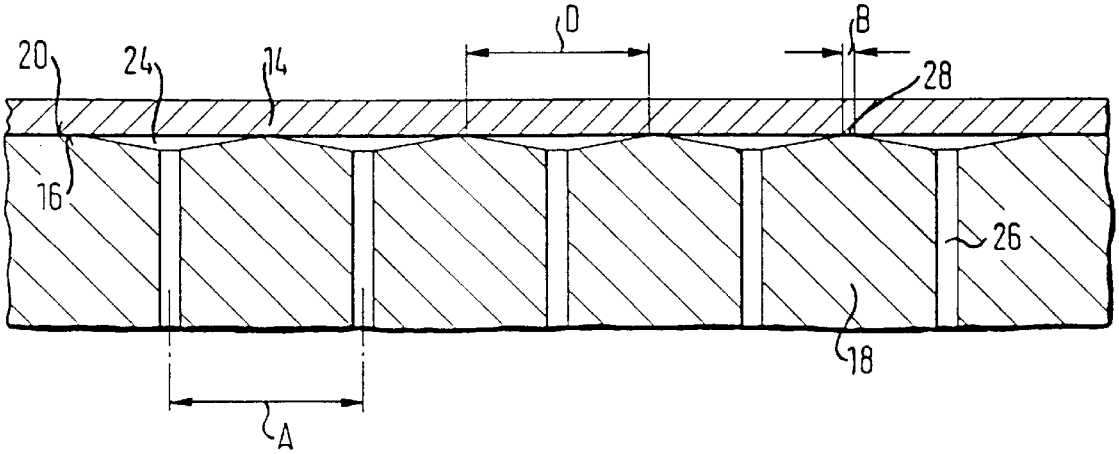
FIG. 8 is a view comparable to FIG. 3, showing the depressions at the oil feed points in detail.

In the embodiment shown in FIGS. 2 and 6, the bores 26 of the oil feed points 22 are arranged upstream or in front of the center of gravity of the support surface depressions 24 in the support surface in the running direction LW of the roll jacket 14, as seen in a top view. This arrangement produces optimum oil distribution in the depressions 24 during operation. However, it is also possible to arrange all of the bores 26 directly at the center of gravity of the depressions in a top view (FIG. 8).

Figure 5:
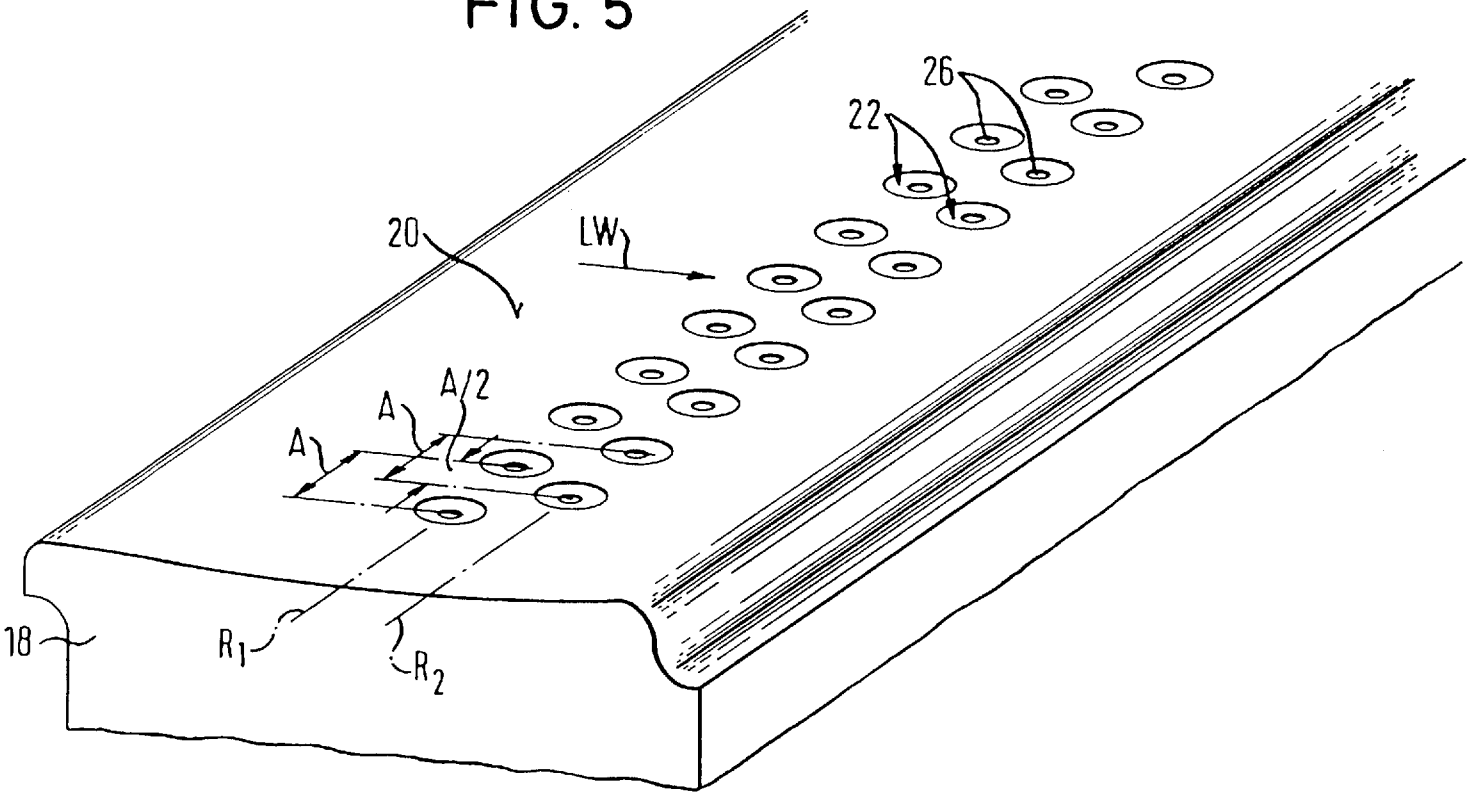
FIG. 5 is a schematic, perspective partial view of a second support element embodiment provided with two rows of oil feed points.

The embodiment shown in FIG. 5 has several, here two, parallel rows $R_i$, each comprised of a plurality of oil feed points 22 that are separated from one another and are supplied at least partially independently of the pressure space. Here, the oil feed points 22 of the two adjacent rows $R_1$ and $R_2$ are offset relative to one another by an amount A/2, crosswise to the running direction LW of the roll jacket 14. This distance A/2 corresponds to half the distance A between the bores in each row of oil feed points, where this distance is preferably essentially the same in the two rows. In the two rows $R_1$ and $R_2$, therefore, the oil feed points 22 in each row are arranged in the gap relative to the feed points in the other row.

In a preferred embodiment, the bores 26 of the oil feed points 22 of one row $R_i$ are spaced a distance A of about 5 to 50 mm, particularly 10 to 30 mm, and preferably about 20 mm apart from one another. In addition, a distance of about 5 to 50 mm, particularly 10 to 30 mm, and preferably about 20 mm, for example, is provided between the bores 26 of the oil feed points 22 of two adjacent rows $R_i$, in the running direction LW of the roll jacket 14.

For achieving the most uniform possible temperature distribution over the support surface 20, it is particularly advantageous if at least one row $R_1$ of a plurality of separated oil feed points 22, which are supplied at least partially independently of the pressure space 19, is arranged in the region between ¼ to ¾, and preferably ½ to ¾ across the support surface, viewed in the running direction LW of the roll jacket 14.

As shown in FIG. 2, it is practical if the width B of the ridges 28 is less than the diameter D of the depressions 24. For practical purposes, the width B of the ridges 28 can be narrower than 10 mm, for example, particularly narrower than 5 mm, preferably narrower than 1 mm and especially preferably narrower than 0.2 mm.

The depressions 24 provided in the support surface 20 and the ridges 28 located between them are preferably formed by etching, particularly by electroerosion.

Figure 7:
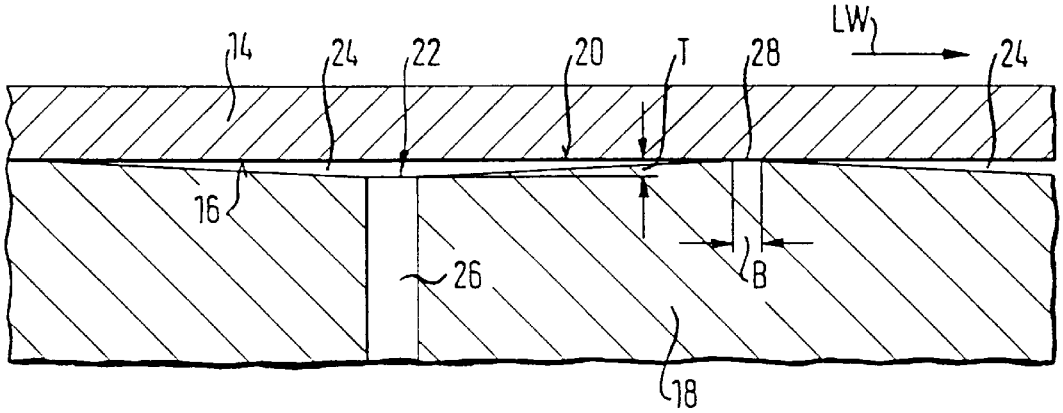
FIG. 7 is a schematic view of another exemplary embodiment of an oil feed point.

The embodiments of FIGS. 6 and 7 have the common feature that the depression 24 of the oil feed point 22, in each instance, makes a continuous transition into the support surface 20 of the support element 18, over an extended distance, in the running direction LW of the roll jacket 14. In FIG. 7, the support surface is formed by ridges 28, which separate each oil feed point 22 from the next one.

FIG. 8 shows a row of oil feed points with a view in the running direction LW. The depression 24 of each bore 26 is separated by a ridge 28 at the level of the support surface 20. As is evident from FIG. 8, the ridge width B is less than the diameter of the depressions 24.

The oil supply can be provided from at least one lateral end surface, or by means of the support element, or from the direction of the carrier, or via a special oil feed pipe 44 (see FIG. 1). Preferably, each oil feed is pressure regulated. The oil flow through the bores is regulated by the pressure drop which occurs at each bore. The pressure oil can also be supplied via the pressure piston 38, in part (see FIG. 4).

The pressure drop across the capillary-like bores results from their bore diameter, the bore length and the consistency and the quantity of the oil. The separation of the oil feed points of each individual row, achieved by means of the ridges and the capillary-like formation of the bores ensures that even when there are non-uniform, different pressures, all regions will be adequately supplied and the maximum flow of oil through the bores will be limited. An optimum oil supply to produce and maintain the lubricant film 34 (see FIG. 1) is therefore always guaranteed, even under critical operating conditions such as when clumps or thickened areas of paper pass through the press zone, for example. In addition, an effective exchange of the oil adhering to the roll jacket is always ensured. This results in optimum temperature distribution with a low level of warming of the lubricant film. This means that the thermal stress on the roll jacket is also kept low. In addition, the low level of warming of the lubricant film reduces the risk of thermal deformation of the support element. Even if irregularities occur, uniform lubrication conditions can be achieved over the width of the support element. In contrast, with purely hydrodynamic or purely hydrostatic lubrication, there is also greater freedom in structuring the pressure profile. The elimination of depressions with edges, in the region of the press zone, is also advantageous.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A press roller comprising a stationary carrier, a roll jacket in the form of an endless loop which is rotatable around the stationary carrier; the roll jacket having an inside circumferential surface;

a support element supported on the carrier, the support element including a support surface which faces outward of the support element, extends in the rotation direction of the roll jacket over the carrier, and is pressable toward the inside circumferential surface of the rotating roll jacket;

the carrier and the support element where it is supported on the carrier together defining a pressure space below the support element for being pressurized with oil to press the support element toward the roll jacket;

a plurality of lubricating oil feed points defined in the support surface for supplying lubricating oil to the region between the support surface and the inside circumferential surface of the roll jacket for hydrodynamically lubricating the roll jacket rotating over the support element; the oil feed points being separated from each other and arranged in at least one row that extends along the support surface generally in the direction of the press roller axis;

an oil feed supplying fresh lubricating oil to the oil feed points at least partially independently of the pressure space which acts on the support element;

each oil feed point comprising a respective local depression in the support surface and a respective bore in the support element located beneath and communicating into each of the depressions, with a throttle in the bore for controlling the feed of oil through the bore into the depression, so that upon rotation of the roll jacket over the carrier, the roll jacket is at least partially hydrodynamically lubricated by the lubricating oil from each depression;

the depressions in the support surface being so profiled as to provide a continuous transition into the support surface and into the ridges between the oil feed points in the support surface at least at one side of the oil feed points in the rotation direction of the roll jacket;

the support surface including a respective upstanding ridge between neighboring ones of the local depressions in the row of oil feed points, the ridges having outer surfaces which lie at least essentially on the same radial level as the regions of the support surface adjacent the ridges and regions of the support surface axially beyond the depressions;

the continuous transition of the depressions is accomplished with a generally convex curvature of the support surface in the depressions.

2. The press roller of claim 1, further comprising an oil communication passage between the pressure space and the support surface, so that fresh lubricating oil for hydrodynamic lubrication is supplied through the oil feed points and oil for hydrodynamic lubrication is also supplied from the pressure space to the support surface.

3. The press roller of claim 2, wherein at least some of the oil feed points in the row thereof are connected with the pressure space to be at least partly provided with lubricating oil from the pressure space which acts on the support element.

4. The press roller of claim 3, wherein the oil distribution to the feed points is such that some of the oil feed points are provided with oil independently of the pressure space and..alternate ones of the oil feed points are provided with oil through communication with the pressure space.

5. The press roller of claim 1, wherein the oil feed points are arranged in at least one row thereof along the axis of the press roller;

the ridges between the neighboring ones of the depressions having a width dimension along the axis of the press roller which is less than the minimum diameter of the neighboring ones of the depressions between which one of the ridges is disposed.

6. The press roller of claim 1, wherein the depressions and the ridges are formed by etching of the support surface.

7. The press roller of claim 1, wherein the depressions extend to a maximum depth of less than 0.5 mm into the support surface.

8. The press roller of claim 1, wherein the depressions extend to a maximum depth of less than 0.3 mm into the support surface.

9. The press roller of claim 1, wherein the depressions extend to a maximum depth of less than 0.1 mm into the support surface.

10. The press roller of claim 1, wherein each depression has a surface center of gravity in the support surface, and the respective oil feed point at each depression is arranged within the surface center of gravity of the respective depression.

11. The press roller of claim 1, wherein each depression has a surface center of gravity in the support surface and the row of oil feed points is toward the front of the surface center of gravity of the depression with reference to the rotation direction of the roll jacket over the support surface.

12. The press roller of claim 1, wherein the depressions in the support surface are so profiled as to provide a continuous transition into the support surface and into the ridges between the oil feed points in the support surface on all sides around the oil feed points.

13. The press roller of claim 1, further comprising a plurality of distributor channels provided in the support element, each of the distributor channels being connected with a respective plurality of the oil feed points, and each of the distributor channels being supplied with fresh lubricant oil so that each distributor channel supplies lubricant oil to the respective oil feed points connected thereto for hydraulic lubrication.

14. The press roller of claim 13, wherein the plurality of the distributor channels are arranged in the support element one after the other along the direction of the roller axis.

15. The press roller of claim 13, wherein each of the distributor channels has at least one inlet opening, and the cross-section of each inlet opening to the respective distributor channel is greater for that channel than the total of the cross-sections of the bores to the oil feed points connected with that channel.

16. The press roller of claim 15, wherein the bores to the oil feed points are formed like capillaries with a diameter in a range of 0.3 mm to 3.0 mm.

17. The press roller of claim 1, wherein the supply of fresh lubricant oil to the oil feed points for hydraulic lubrication is provided completely independent of the pressure space which acts on the support element.

18. The press roller of claim 1, further comprising at least one distributor channel in the support element jointly supplying the oil feed points in the support surface with fresh lubricant oil for hydraulic lubrication.

19. The press roller of claim 18, wherein the distributor channel extends generally in a direction along the roller axis.

20. The press roller of claim 18, wherein the distributor channel has at least one inlet opening, and the cross-section of the inlet opening is greater than the total of the cross-sections of the bores to the oil feed points supplied by the distributor channel.

21. The press roller of claim 20, wherein the bores to the oil feed points are formed like capillaries with a diameter in a range of 0.3 mm to 3.0 mm.

22. The press roller of claim 21, wherein each bore has an outlet at the support surface, and each bore in the support element is connected between the distributor channel and the outlet from the bore toward the support surface has a length in the range of 3 mm to 100 mm.

23. The press roller of claim 21, wherein each bore has an outlet at the support surface, and each bore in the support element connected between the distributor channel and the outlet from the bore toward the support surface has a length in the range of 5 mm to 50 mm.

24. The press roller of claim 20, wherein the bores to the oil feed points are formed like capillaries with a diameter of about 1 mm.

25. The press roller of claim 20, wherein the oil pressure in the region of the inlet from the distributor channel into the entrance to the bores is greater than the pressure of the lubricant film that develops over the support surface of the support element as the roll jacket rotates.

26. The press roller of claim 18, wherein the bores to the oil feed points are formed like capillaries with a diameter in a range of 0.3 mm to 3.0 mm.

27. The press roller of claim 26, wherein each bore has an outlet at the support surface, and each bore in the support element is connected between the distributor channel and the outlet from the bore toward the support surface has a length in the range of 3 mm to 100 mm.

28. The press roller of claim 18, wherein the bores in the support element are at least in part individually connected with the distributor channel in the support element.

29. The press roller of claim 28, further comprising a valve for adjusting the pressure and/or volume of fresh lubricant oil supplied through each of each of the bores.

30. The press roller of claim 18, wherein some of the bores are grouped together in separate respective groups and are, at least in part, as a group connected with the distributor channel in the support element.

31. The press roller of claim 30, further comprising a valve for adjusting the pressure and/or volume of fresh lubricant oil supplied through each of each of the groups of bores.

32. The press roller of claim 18, wherein the supply of fresh lubricant oil to the oil feed points is provided completely independent of the pressure space which acts on the support element.

33. The press roller of claim 18, further comprising at least a second row of a plurality of oil feed points for hydraulic lubrication, the oil feed points of the second row being separated from each other and the second row also extending along the axis of the press roller, the second row being spaced from the first row of oil feed points along the direction of movement of the roll jacket.

34. The press roller of claim 33, wherein the oil feed points of the second row are in communication with the pressure space for receiving oil from the pressure space, whereby the first row is supplied at least partially independently of the pressure space and the second row is supplied from the pressure space.

35. The press roller of claim 34, wherein the oil feed points in two adjacent rows of the oil feed points on the support surface are placed so that the oil feed points of one row are offset relative to the oil feed points in the adjacent row in the direction cross-wise to the running direction of the roll jacket over the support surface, whereby an oil feed point in one row is in the gap between oil feed points in the adjacent row.

36. The press roller of claim 33, further comprising respective supplies of oil, supplied to each of the rows of oil feed points and independent of the pressure space.

37. The press roller of claim 36, further comprising valves for separately adjusting the oil feed to the oil feed points in the first row and the second row of oil feed points in the support surface.

38. The press roller according to claim 18, where the oil supply to the individual oil feed points in the row thereof are separately adjustable.

39. The press roller of claim 38, wherein the oil pressure in the bores to the oil feed points are adjustable to a high enough value that the roll jacket is hydrostatically supported at the support surface by the oil at the oil feed points in the support surface.

40. The press roller of claim 18, wherein oil feed points in a row are at a distance apart along the press roller axis of about 5 mm to 50 mm.

41. The press roller of claim 18, wherein oil feed points in a row are at a distance apart along the press roller axis of about 10 mm to 30 mm.

42. The press roller of claim 18, wherein oil feed points in a row are at a distance apart along the press roller axis of about 20 mm.

43. The press roller of claim 18, wherein the oil feed points in the row thereof are positioned along the support surface in the direction of rotation of the roll jacket past the support surface in the region between ¼ to ¾ of the length of the support surface in the rotation direction.

44. The press roller of claim 18, wherein the oil feed points in the row thereof are positioned along the support surface in the direction of rotation of the roll jacket past the support surface in the region between ½ to ¾ of the length of the support surface in the rotation direction.

45. The press roller of claim 44, wherein the width of the ridges is less than 10 mm.

46. The press roller of claim 44, wherein the width of the ridges is less than 5 mm.

47. The press roller of claim 44, wherein the width of the ridges is less than 1 mm.

48. The press roller of claim 44, wherein the width of the ridges is less than 0.2 mm.

49. The press roller of claim 18, wherein the support has a center region and has lateral edge regions and the oil feed points in the row thereof are generally in the lateral edge regions of the support surface and out of the center region thereof.

50. The press roller of claim 18, wherein the support has a center region and has lateral edge regions and the oil feed points in the row thereof are generally toward the center region.

51. The press roller of claim 50, wherein the support surface is generally concavely shaped to cooperate with the surface of a counter roller and the roll jacket passes between the support surface and the counter roll.

52. The press roller of claim 18, wherein the roll jacket is an endless loop flexible material belt.

* * * * *